US011198158B2

(12) United States Patent
Kirchner et al.

(10) Patent No.: US 11,198,158 B2
(45) Date of Patent: Dec. 14, 2021

(54) FLIP-FLOW SCREENER MACHINE WITH OPTIMISED SCREEN BOTTOM FASTENING

(71) Applicant: HEIN, LEHMANN GMBH, Krefeld (DE)

(72) Inventors: Markus Kirchner, Rheurdt (DE); Ernst Grubl, Versen (DE); Rolf Kadel, Weinheim (DE); Matthias Sattler, Bensheim (DE); Peter Palmen, Monchengladbach (DE)

(73) Assignee: HEIN, LEHMANN GMBH, Krefeld (DE)

( * ) Notice: Subject to any disclaimer, the term of this patent is extended or adjusted under 35 U.S.C. 154(b) by 237 days.

(21) Appl. No.: 16/333,624

(22) PCT Filed: Sep. 29, 2017

(86) PCT No.: PCT/EP2017/001157
§ 371 (c)(1),
(2) Date: Mar. 15, 2019

(87) PCT Pub. No.: WO2018/065089
PCT Pub. Date: Apr. 12, 2018

(65) Prior Publication Data

US 2019/0217339 A1 Jul. 18, 2019

(30) Foreign Application Priority Data

Oct. 5, 2016 (DE) ..... 10 2016 011 817.2

(51) Int. Cl.
*B07B 1/36* (2006.01)
*B07B 1/48* (2006.01)
*B07B 1/46* (2006.01)

(52) U.S. Cl.
CPC ..... *B07B 1/485* (2013.01); *B07B 1/36* (2013.01); *B07B 1/4645* (2013.01); *B07B 2201/02* (2013.01)

(58) Field of Classification Search
CPC ..... B07B 1/485; B07B 1/36; B07B 1/4645; B07B 1/46; B07B 1/48
See application file for complete search history.

(56) References Cited

U.S. PATENT DOCUMENTS 2,703,649 A * 3/1955 Cheyette ..... B07B 1/485 209/314
5,062,949 A * 11/1991 Hausmann ..... B07B 1/46 209/310

(Continued)

FOREIGN PATENT DOCUMENTS

AT 8742 U1 12/2006
DE 2924571 A1 1/1981

(Continued)

OTHER PUBLICATIONS

International Search Report in related PCT Application No. PCT/EP2017/001157, dated Feb. 22, 2018.

(Continued)

*Primary Examiner* — Patrick H Mackey
(74) *Attorney, Agent, or Firm* — Bacon & Thomas, PLLC

(57) ABSTRACT

A flip-flow screener machine includes a carrier frame with primary, drive-induced vibration, to which a vibrating frame is coupled in a freely oscillating manner by means of elastic transmission elements and is excited and set to vibrate secondarily by the carrier frame via said transmission elements, transverse carriers being arranged on the carrier frame and on the vibrating frame, a transverse carrier on the vibrating frame lying downstream of a transverse carrier on said carrier frame, with a flexible screen bottom being arranged between two transverse carriers and detachably (Continued)

secured to said transverse carriers, each of the screen bottoms including at least one undercut portion by means of which they can engage behind an undercut on the transverse carrier, and two adjacent screen bottoms abutting one another directly at their front ends.

8 Claims, 5 Drawing Sheets

(56) References Cited

U.S. PATENT DOCUMENTS 5,085,324 A * 2/1992 Dehlen ..... B07B 1/4645 209/314
5,613,613 A * 3/1997 Ahorner ..... B07B 1/485 209/310
5,735,409 A * 4/1998 Malmberg ..... B07B 1/4645 209/399
7,654,394 B2 * 2/2010 LaVeine ..... B07B 1/28 209/310
8,757,392 B2 * 6/2014 LaVeine ..... B07B 1/485 209/319
2002/0195377 A1 * 12/2002 Trench ..... B07B 1/4645 209/365.1
2004/0149632 A1 8/2004 Schulte, Jr. et al.

FOREIGN PATENT DOCUMENTS

DE 3013737 A1 10/1981
DE 3621902 A1 1/1988
EP 0167999 A2 1/1986
EP 0736336 A1 10/1996
EP 1957210 B1 * 8/2015 ..... B07B 1/4672
WO WO-2016124020 A1 * 8/2016 ..... B07B 1/42

OTHER PUBLICATIONS

Written Opinion in related PCT Application No. PCT/EP2017/001157, dated Feb. 22, 2018.

* cited by examiner

FLIP-FLOW SCREENER MACHINE WITH OPTIMISED SCREEN BOTTOM FASTENING

The invention relates to a flip-flow screening machine comprising a carrier frame which is primarily energized by means of a drive, can be caused to oscillate, and to which an oscillating frame is coupled, so as to be freely suspended, by means of resilient transmission elements, which oscillating frame experiences secondary energization from the carrier frame, and is caused to oscillate, by means of the transmission elements, wherein crossbeams are arranged on the carrier frame and on the oscillating frame, wherein a crossbeam arranged on the carrier frame is followed, in each case, by a crossbeam arranged on the oscillating frame, and a flexible screen lining is arranged between two crossbeams in each case and is releasably fastened to the crossbeams.

BACKGROUND OF THE INVENTION

Flip-flow screening machines of this kind are known. In order to make it possible to replace worn screen linings, the screen linings are releasably fastened to the crossbeams. A flip-flow screening machine of this kind is known from DE 30 13 737 A1, in which the screen linings are connected to the crossbeams by means of clamping strips. A flip-flow screening machine is known from DE 36 21 902 C2, in which the screen linings are fastened to the crossbeams by means of screws.

A disadvantage in this case is that the use of additional components in the form of the clamping strip or in the form of the screws make assembly more complex. A further disadvantage is that the clamping strips or the screws form undesired edges on the upper face of the screen linings on which the screened material catches.

SUMMARY OF THE INVENTION

The object of the invention is that of overcoming said disadvantages and in particular simplifying the assembly of the screen linings.

This object is achieved according with the invention by means of a flip-flow screening machine according to the present specification and drawings. Advantageous developments of the invention are also specified in the present specification and drawings.

A particular advantage of the flip-flow screening machine, comprising a carrier frame which is primarily energized by means of a drive, can be caused to oscillate, and to which an oscillating frame is coupled, so as to be freely suspended, by means of resilient transmission elements, which oscillating frame experiences secondary energization from the carrier frame, and is caused to oscillate, by means of the transmission elements, wherein crossbeams are arranged on the carrier frame and on the oscillating frame, wherein a crossbeam arranged on the carrier frame is followed, in each case, by a crossbeam arranged on the oscillating frame, and a flexible screen lining is arranged between two crossbeams in each case and is releasably fastened to the crossbeams, is that the screen linings in each case comprise at least one undercut, by means of which said linings engage behind an undercut on the crossbeam, and in each case the end faces of two adjacent screen linings come into direct contact with one another.

In the case of flip-flow screening machines of his kind, the carrier frame is caused to oscillate by means of a drive. The oscillating frame is fastened to the carrier frame in a freely suspended manner by means of resilient transmission elements. The transmission of the oscillations from the primarily energized carrier frame to the freely suspended oscillating frame by means of the transmission elements also causes the oscillating frame to oscillate. Crossbeams are arranged on the carrier frame and on the oscillating frame, between which crossbeams screen linings are fastened in each case. The crossbeam of the carrier frame and the crossbeam of the oscillating frame alternate in each case. The relative movement of the oscillating frame with respect to the carrier frame stretches and compresses the screen linings which are fastened to the crossbeams and in each case extend from one crossbeam to the next crossbeam. As a result, the screened material that is applied to the screen linings is accelerated rapidly.

Since the screen linings in each case comprise at least one undercut, by means of which said screen linings engage behind an undercut on the crossbeam, the screen linings can be fastened to the crossbeams in a very simple manner. A further particular advantage is that in each case the end faces of two adjacent screen linings come into direct contact with one another, such that the gap between the adjacent screen linings is closed and none of the screened material can penetrate into the gap.

Particularly preferably, the screen linings engage behind the undercut on the crossbeam in a form-fit manner, Forming a form-fit connection of this kind ensures secure fastening of the screen linings to the crossbeams in a simple manner Preferably, the end faces of two adjacent screen linings in each case come into contact with one another in an elastically deformed manner. Preferably, the end faces of the screen linings are oversized, and thus the end faces of two adjacent screen linings in each case come into contact with one another in an elastically deformed manner. An oversized end face of the screen linings of this kind, and the elastic deformation, ensures that the gap between the screen linings is sealed with respect to the upper face. The upper face of the screen linings refers to the face of the screen linings that comes into contact with the screened material to be processed.

Preferably, the end faces of two adjacent screen linings in each case are elastically deformed and, together with the adjacent screen lining, form a transition region that is sealed at least with respect to the upper face of the screen linings. The transition region that is sealed with respect to the upper face of the screen linings ensures that the gap between the screen linings is reliably sealed even in the case of high accelerations, and that no screened material can penetrate therein.

The end faces of the screen linings may be oversized over the entire height, or the end face may be slanted in the sense that the oversize of the end face reduces towards the upper face, in order to ensure particularly tight closure of the gap towards the upper face by means of the elastic deformation of the screen linings with respect to one another.

Preferably, two adjacent screen linings in each case block one another. After the screen linings have been inserted into the crossbeam, in which process in each case at least one undercut of the screen linings can engage behind an undercut on the crossbeam, mutual blocking of the screen linings can be achieved by means of a corresponding geometrical design of the crossbeams and screen linings Particularly preferably, the end faces of the screen linings comprise at least one undercut, wherein the end faces of two adjacent screen linings in each case form a form-fit connection. A form-fit connection of the kind between the screen linings of which the end faces are in contact with one another makes it possible to further reinforce the mutual blocking of the screen linings. In particular, the end faces of the screen linings may be sawtooth-shaped in side view, which shape interacts with corresponding counterparts on the opposing screen lining and forms a form-fit connection.

Particularly preferably, two adjacent screen linings in each case are positioned in a force-fit manner in a groove of the crossbeam. The fact that two adjacent screen linings in each case are positioned in a form-fit and simultaneously force-fit manner in a groove of the crossbeam additionally ensures the fastening of the screen linings to the crossbeams, with the result that the stability of the flip-flow screening machine is increased.

In a preferred embodiment, in each case two adjacent screen linings in the transport direction of the flip-flow screening machine form a downwards step. The transport direction of the flip-flow screening machine refers to the movement direction of the screened material, to be processed, on the flip-flow screening machine, from the feed side in the direction of the discharge of the flip-flow screening machine. The screened material to be processed is supplied on the feed side of the flip-flow screening machine, and, after being further transported on the upper face of the screen linings, is carried away via the discharge side of the flip-flow screening machine. For this purpose, the flip-flow screening machine is positioned such that at least the oscillating frame of the flip-flow screening machine has an incline from the feed to the discharge. It is advantageous in this case for two adjacent screen linings in the transport direction of the flip-flow screening machine to form a downwards step which is conducive to the screened material becoming detached from the screen linings and being broken at the edge of the step.

According to a preferred embodiment, the first screen lining of a pair of successive screen linings overlaps the following screen lining in the transport direction of the flip-flow screening machine. An overlap of this kind closes the gap between the adjacent screen linings, such that penetration and deposits of screened material in the gap between the screen linings is reliably prevented. In particular, the overlap can be achieved in such a way that a step oriented downwards in the transport direction of the flip-flow screening machine is simultaneously formed.

BRIEF DESCRIPTION OF THE DRAWINGS

A plurality of embodiments of the invention are shown in the figures and will be explained in the following. In the figures.

DETAILED DESCRIPTION OF THE INVENTION

Figure 1:
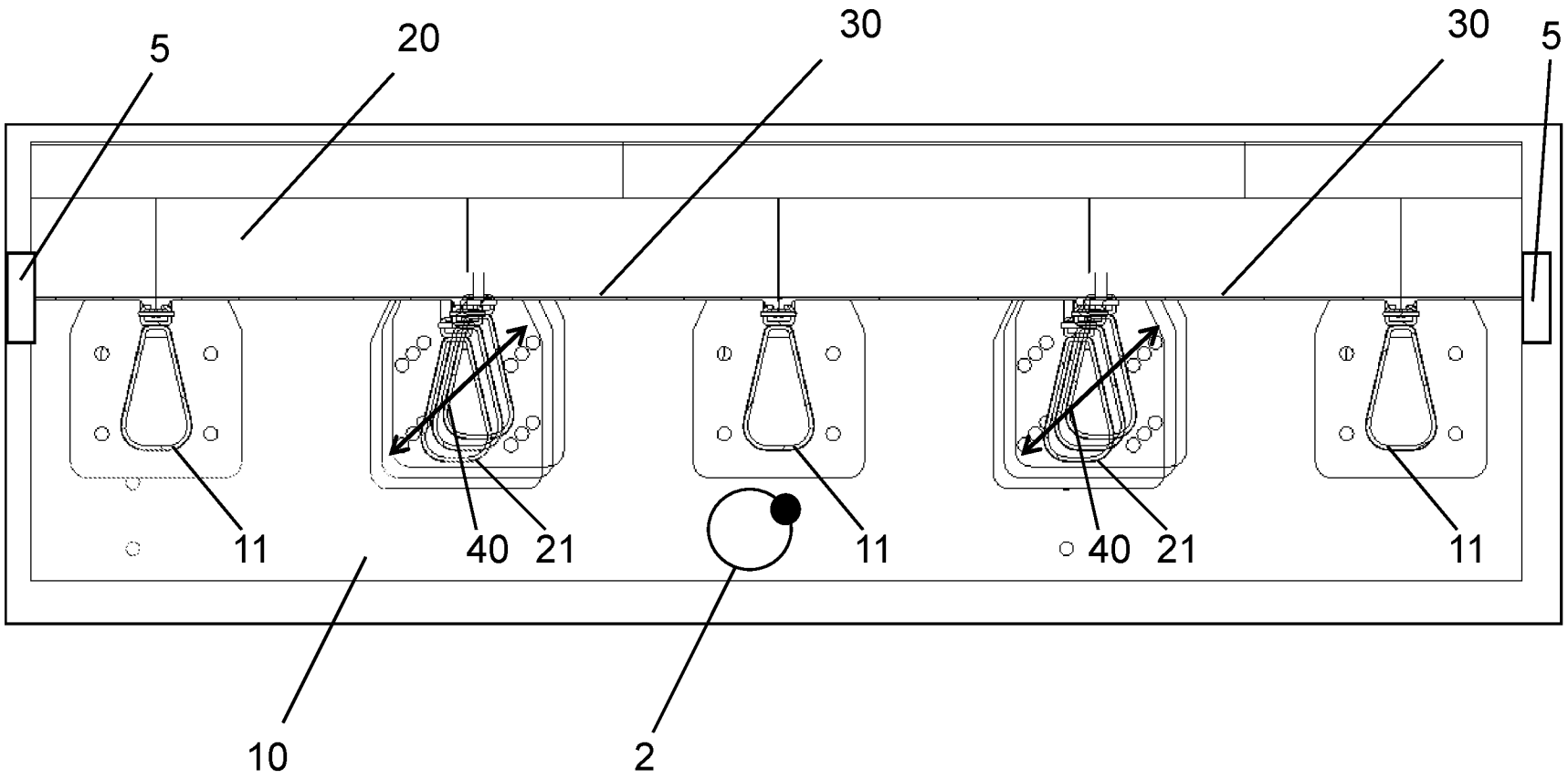
FIG. 1 is a schematic side view of a flip-flow screening machine, showing the movement of the crossbeam on the oscillating frame.
Figure 2:
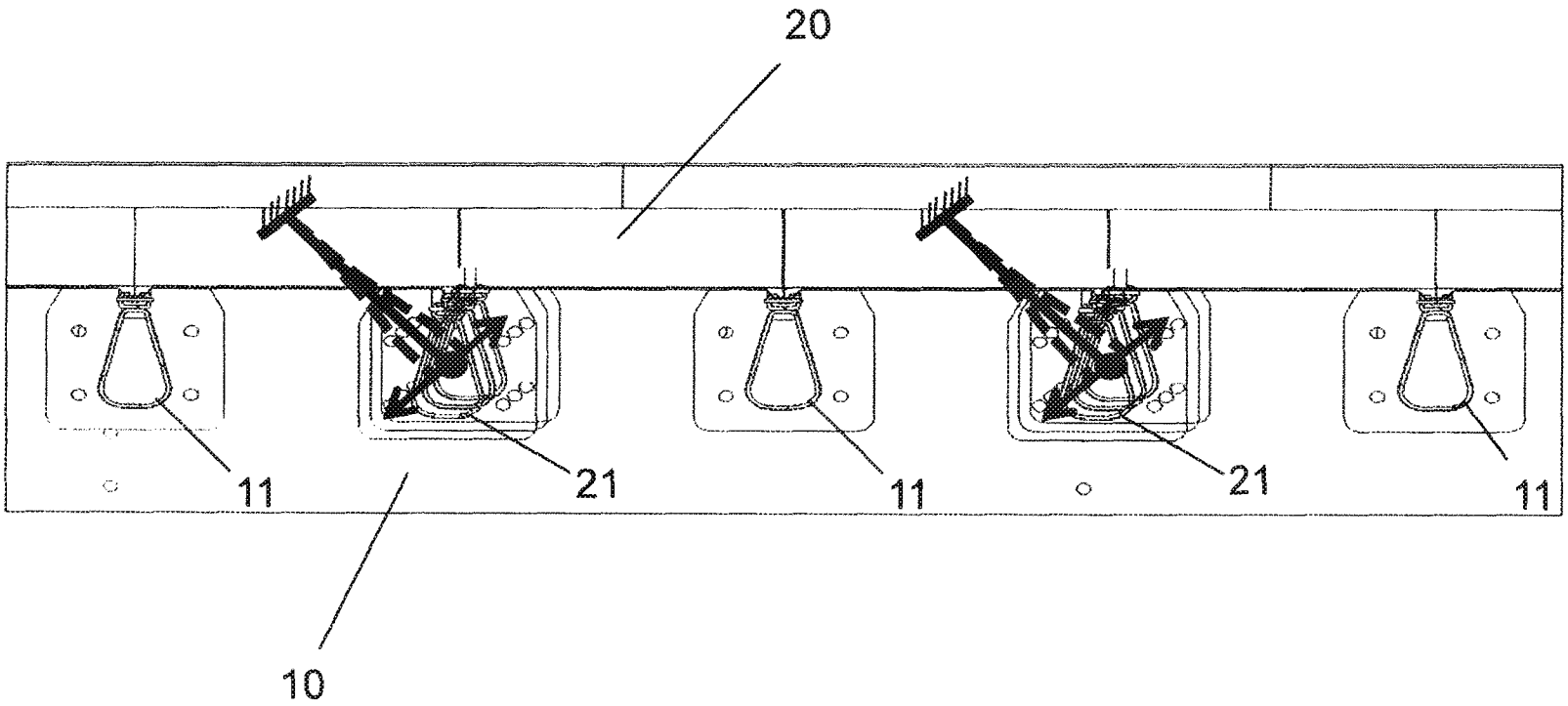
FIG. 2 shows an embodiment of the energization of the crossbeam on the oscillating frame.

In the figures, identical components and modules are provided with identical reference signs. The drawings in FIGS. 1 and 2 are purely schematic. FIG. 1 is a schematic side view of a flip-flow screening machine comprising the carrier frame 10 which forms the system I. The system I is primarily energized by means of a drive. The oscillating frame 20 is hinged to the carrier frame 10 in a freely suspended manner by means of resilient transmission elements. The oscillating frame 20 thus forms the system II. Suspending the oscillating frame 20 on resilient transmission elements allows the oscillating frame 20 to be suspended freely with respect to the carrier frame 10 and to thus perform relative movements with respect to the carrier frame 10.

A series of first crossbeams 11 are fastened to the carrier frame 10. The crossbeams 21 of the oscillating frame 20 are fastened on the oscillating frame 20, freely suspended on the carrier frame 10, between the first crossbeams 11 of the carrier frame 10 in each case. First crossbeams 11 of the carrier frame 10 and second crossbeams 21 of the oscillating frame 20 are thus arranged in the flip-flow screening machine so as to alternate. Screen linings 30 are arranged between the crossbeams 11, 21, which screen linings are in each case fastened to the crossbeams. The fastening of the screen linings 30 to the crossbeams is explained below, with reference to the embodiments according to FIGS. 4 and 5.

In FIG. 1 the relative movement of the oscillating frame 20 with respect to the carrier frame 10 is indicated by the double arrow 40. In the embodiment according to FIG. 1, this is a linear movement of the oscillating frame 20 with respect to the carrier frame 10.

FIG. 2 schematically shows an embodiment of the energization of the movement of the system II, comprising the oscillating frame 20 and the crossbeams 21 fastened thereto. For this purpose, as shown in the schematic view according to FIG. 2, the oscillating frame 20 is freely suspended on the carrier frame 10. The suspension of the oscillating frame 20 is achieved by means of resilient transmission elements, such that said oscillating frame is freely suspended on the carrier frame 10. In the schematic view according to FIG. 2, this is again a linear movement of the oscillating frame 20 with respect to the carrier frame 10.

Figure 3:
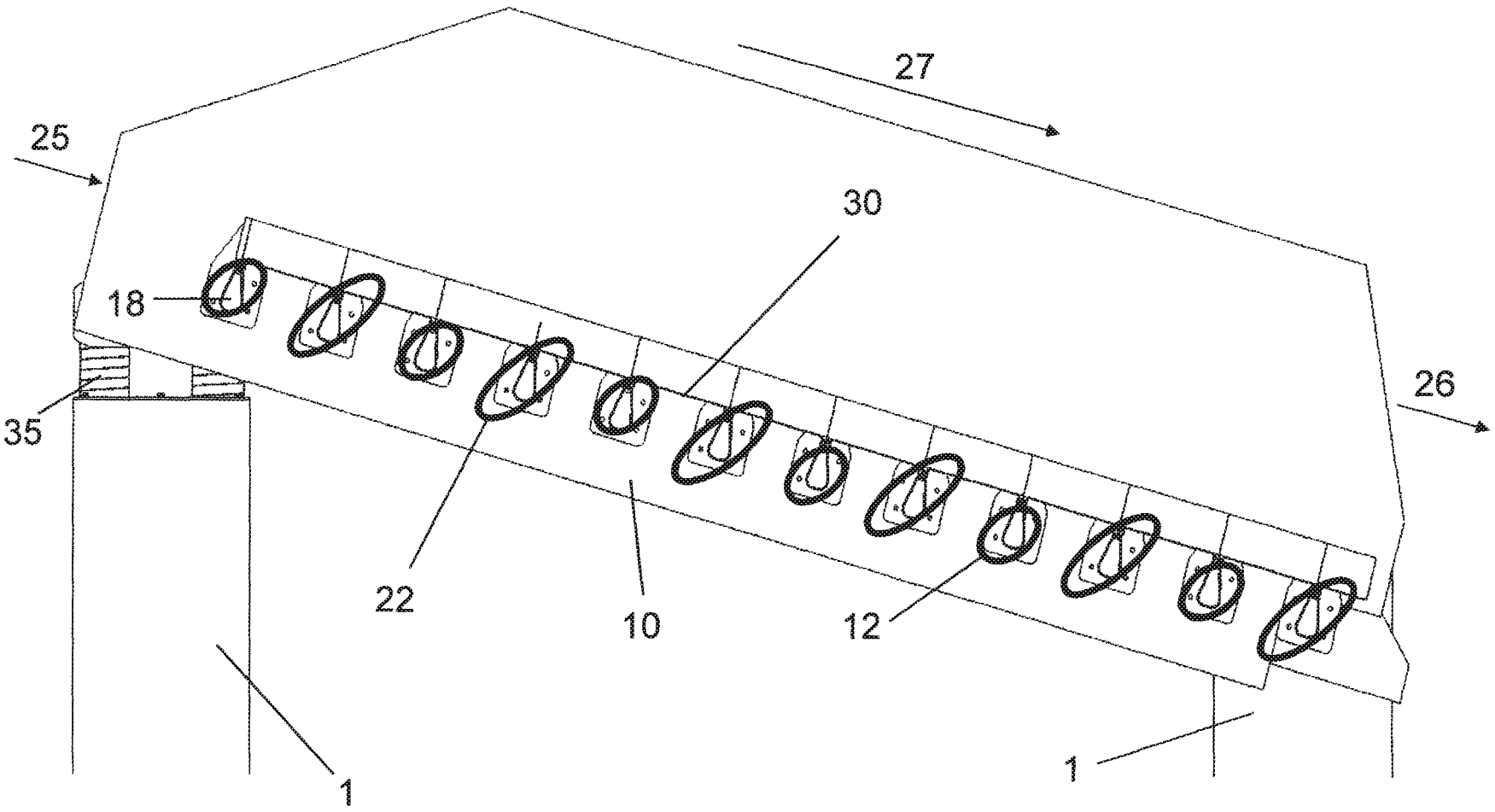
FIG. 3 shows the movements of the oscillating frame and of the carrier frame.

FIG. 3 shows a further embodiment of a flip-flow screening machine. In this case, the flip-flow screening machine comprising the carrier frame 10 and the oscillating frame that is mounted thereon so as to be freely suspended, is set at an angle relative to the horizontal. The carrier frame 10 forms the system I. The oscillating frame, which is hidden in the side view according to FIG. 3, forms the system II. Setting the carrier frame 10 and the oscillating frame so as to be at an angle relative to the horizontal, in this manner, facilitates the transport of the screened material from the feed 25 to the discharge 26. The transport direction of the screened material on the screen linings 30, along the oscillating frame, from the feed 25 to the discharge 26, is shown by the arrow 27. The flip-flow screening machine is mounted on foundations 1 by means of helical springs 35.

The system I is formed by the carrier frame 10. The carrier frame 10 is primarily energized, such that the crossbeams 11 fixed to the carrier frame move according to the ellipse 12. The primary energization of the carrier frame 10 is achieved by means of two unbalanced shafts, wherein the two unbalanced shafts have different centers of gravity. The inclination of the ellipse 12 with respect to the horizontal is selected by the relative positioning of the centers of gravity of the two unbalanced shafts with respect to one another.

The system II, which is formed by the oscillating frame, is coupled to the system I, in the form of the carrier frame 10, in a freely suspended manner by means of the transmission elements. The oscillation of the carrier frame 10, as shown by the ellipses 12, causes the oscillating frame to oscillate, as shown by the ellipses 22. This means that the crossbeams 21 that are arranged on the oscillating frame perform a movement corresponding to the ellipses 22. The different movement of the oscillating frame with respect to the carrier frame 10 stretches and compresses the screen linings 30, with the result that screened material applied to the screen linings 30 is accelerated rapidly and thereby processed. The screened material is transported in the direction of the transport direction 27, from the feed 25 to the discharge 26 of the flip-flow screening machine. As can be seen in FIG. 3, the main movement direction of the ellipses 22 is set so as to be at an angle with respect to the transport direction 27. In this case, the main movement direction of the ellipses 22 refers to the connecting line between the focal points of the movement ellipse 22.

Setting the main direction of the ellipse 22 so as to be at an angle, with respect to the transport direction 27, greatly increases the acceleration of the screened material on the screen linings 30. As a result, the transport capacity of the screened material in the transport direction 27 can be increased, such that the setting angle of the oscillating frame with respect to the horizontal can be reduced compared with conventional screening machines. This reduction in the setting angle with respect to the horizontal reduces the installation height of the flip-flow screening machine.

Figure 4:
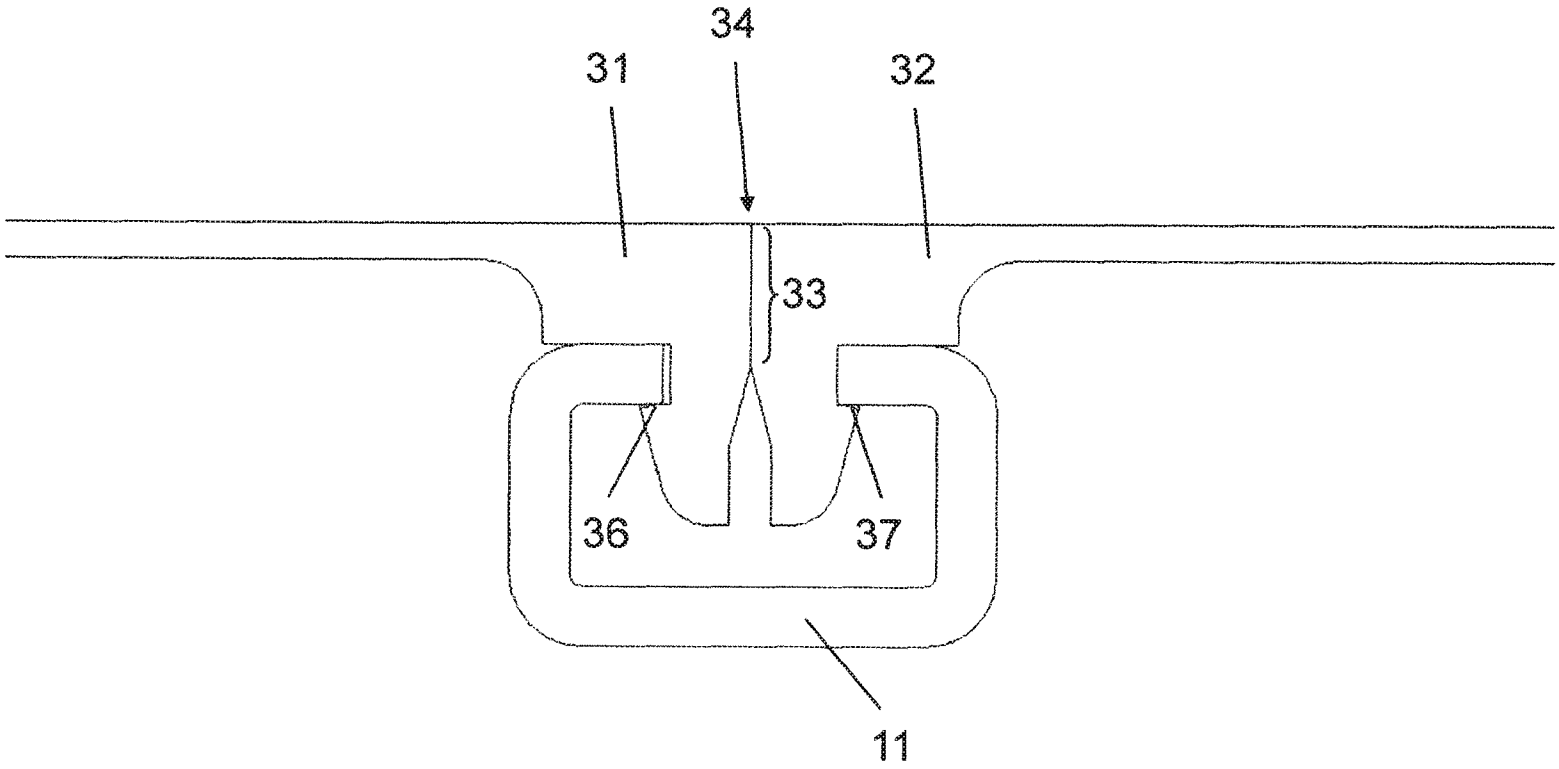
FIG. 4 is a cross section of a first embodiment of a crossbeam comprising screen linings fastened thereto.
Figure 5:
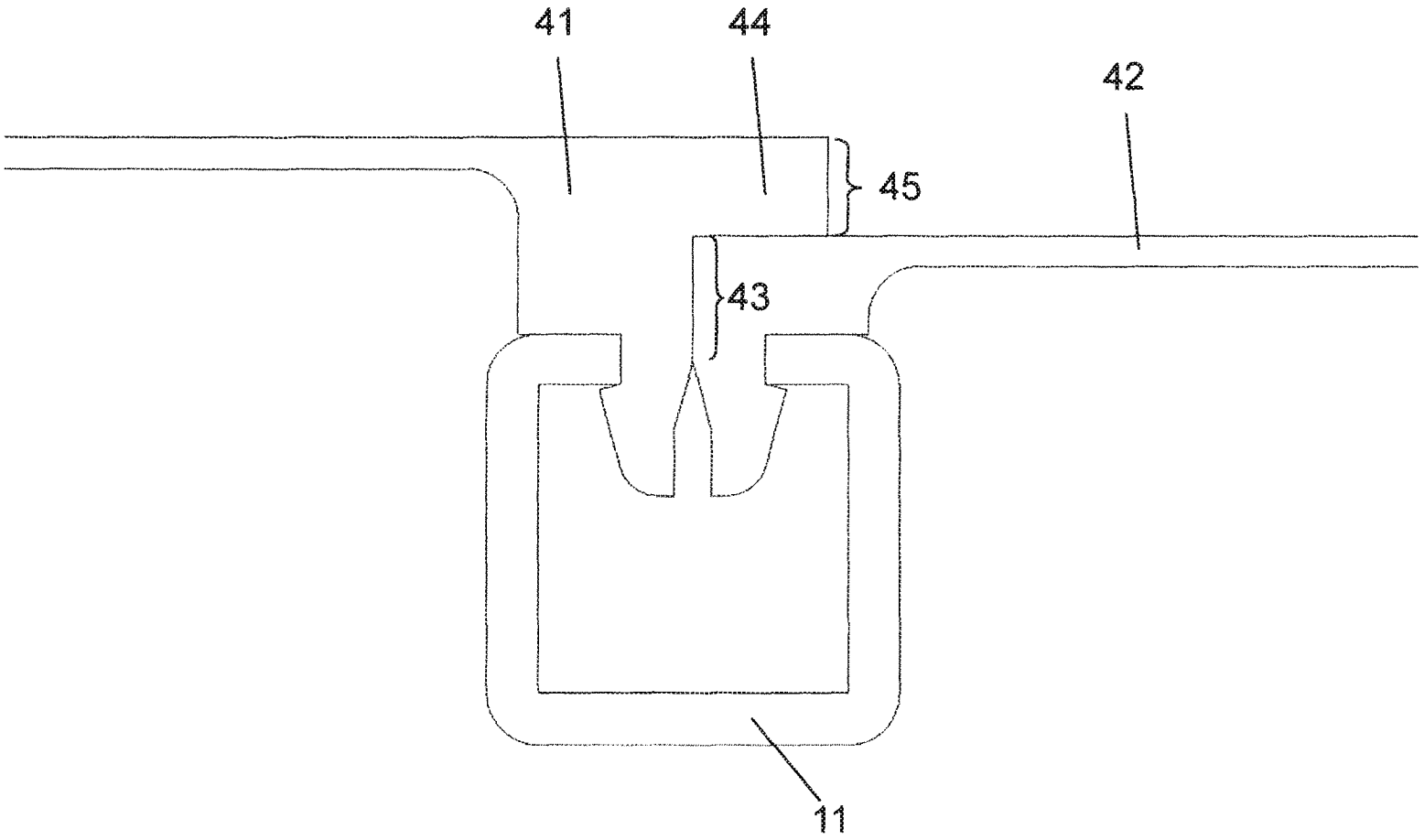
FIG. 5 is a cross section of a second embodiment of a crossbeam comprising screen linings fastened thereto.

Two embodiments of the fastening of the screen linings 30 to the crossbeams 11, 21 is shown in FIGS. 4 and 5 and is explained below.

FIG. 4 shows a first embodiment of the screen lining fastening to a crossbeam 11. The end faces of two adjacent screen linings 31, 32, in each case, come into direct contact with one another, wherein the screen linings 31, 32 are oversized, such that a contact region 33 results in which the two screen linings 31, 32 come into contact with one another in an elastically deformed manner. Said elastic deformation of the end faces of the screen linings 31, 32 seals the gap 34 with respect to the upper face. Said sealing of the gap 34 ensures that no screened material resting on the upper face can penetrate into the gap between the two screen mats 31, 32.

The screen linings 31, 32 each comprise an undercut 36, 37. The screen linings 31, 32 engage behind the crossbeams 11 by means of said undercuts 36, 37. As can be seen in FIG. 4, the screen linings 31, 32, of which the end faces are in contact with one another, block one another when installed, and thus secure one another from unintentionally slipping out of the screen linings 31, 32 clamped in the crossbeams 11

The crossbeam 11 is formed for example by an open U-shaped profile, and comprises inwardly facing undercuts, wherein each of the two undercuts of the crossbeam 11 interacts with one undercut 36, 37, in each case, of the two screen linings 31, 32, and forms a form-fit connection.

The fact that, in the embodiment shown, the end faces of the screen linings have a projection in a height range of 50%, which causes the screen linings 31, 32 to come into contact with one another in an elastically deformed manner in the contact region 33, results in sealing of the gap 34 with respect to the upper face. At the same time, the elastic deformation causes the screen linings to be clamped against one another in the portion 33, and to thus rest and be clamped in the gap of the crossbeam 11 in both a form-fit and a force-fit manner.

FIG. 5 is a cross-section of a further embodiment of the screen lining fastening to the crossbeam 11. Once again, the two opposing screen linings 41, 42 each comprise an undercut which forms a form-fit connection to the crossbeam 11 in order to fasten the two screen linings 41, 42. Furthermore, the screen linings come into contact with one another in a region 43 such that said screen linings are elastically deformed and block one another.

The crossbeam 11 is formed by an open U-shaped profile, and comprises inwardly facing undercuts, wherein each of the two undercuts of the crossbeam 11 interacts with one undercut, in each case, of the two screen linings 31, 32, and forms a form-fit connection.

The transport direction in FIG. 5 corresponds to the direction from left to right, in the drawing plane. The first screen lining 41 in the transport direction comprises a projection 44 which protrudes over the adjacent screen lining 42 in the transport direction and thus forms the downwards step 45, from left to right, in the transport direction. As a result, the screened material is broken at the edge of the step and the removal is improved.

The crossbeam of the carrier frame and the crossbeam of the oscillating frame are arranged in succession in the transport direction, so as to alternate in each case. The relative movement of the oscillating frame with respect to the carrier frame causes the screen linings to be alternately stretched and compressed, and for the screened material, to be processed, to be accelerated thereby.

The invention claimed is:

1. A flip-flow screening machine, comprising:

a carrier frame which is primarily energized by means of a drive, is configured to oscillate, and to which an oscillating frame is coupled, so as to be freely suspended, by resilient transmission elements, which oscillating frame experiences secondary energization from the carrier frame, and is caused to oscillate, by the transmission elements, wherein crossbeams are arranged on the carrier frame and on the oscillating frame, wherein a crossbeam arranged on the carrier frame is followed, in each case, by a crossbeam arranged on the oscillating frame, and a flexible screen lining is arranged between two crossbeams in each case and is releasably fastened to the crossbeams, wherein the screen linings in each case comprise at least one undercut, by which said linings engage behind an undercut on the crossbeam, and in each case the end faces of two adjacent screen linings come into direct contact with one another, and wherein the end faces of the screen linings are oversized, and the end faces of two adjacent screen linings in each case come into contact with one another in an elastically deformed manner.

2. The flip-flow screening machine according to claim 1, wherein the screen linings engage behind the undercut on the crossbeam in a form-fit manner.

3. The flip-flow screening machine according to claim 1, wherein the end faces of two adjacent screen linings in each case are elastically deformed and, together with the adjacent screen lining, form a transition region that is sealed at least with respect to the upper face of the screen linings.

4. The flip-flow screening machine according to claim 1, wherein two adjacent screen linings in each case block one another.

5. The flip-flow screening machine according to claim 1, wherein the end faces of the screen linings comprise at least one undercut, and the end faces of two adjacent screen linings in each case form a form-fit connection.

6. The flip-flow screening machine according to claim 1, wherein two adjacent screen linings in each case are positioned in a force-fit manner in a groove of the crossbeam.

7. The flip-flow screening machine according to claim 1, wherein in each case two adjacent screen linings in the transport direction of the flip-flow screening machine form a downwards step.

8. A flip-flow screening machine, comprising:

a carrier frame which is primarily energized by means of a drive, is configured to oscillate, and to which an oscillating frame is coupled, so as to be freely suspended, by resilient transmission elements, which oscillating frame experiences secondary energization from the carrier frame, and is caused to oscillate, by the transmission elements, wherein crossbeams are arranged on the carrier frame and on the oscillating frame, wherein a crossbeam arranged on the carrier frame is followed, in each case, by a crossbeam arranged on the oscillating frame, and a flexible screen lining is arranged between two crossbeams in each case and is releasably fastened to the crossbeams, wherein the screen linings in each case comprise at least one undercut, by which said linings engage behind an undercut on the crossbeam, and in each case the end faces of two adjacent screen linings come into direct contact with one another, and wherein the first screen lining of a pair of successive screen linings overlaps the following screen lining in the transport direction of the flip-flow screening machine.

* * * * *